US011604012B2

(12) United States Patent
Rahhal

(10) Patent No.: US 11,604,012 B2
(45) Date of Patent: Mar. 14, 2023

(54) OIL SUMP FOR MULTI-COMPRESSOR HVAC AND R SYSTEM

(71) Applicants: Carrier Corporation, Palm Beach Gardens, FL (US); Charbel Rahhal, Lyons (FR)

(72) Inventor: Charbel Rahhal, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 146 days.

(21) Appl. No.: 17/056,327

(22) PCT Filed: May 18, 2018

(86) PCT No.: PCT/IB2018/000913

§ 371 (c)(1),
(2) Date: Nov. 17, 2020

(87) PCT Pub. No.: WO2019/220168

PCT Pub. Date: Nov. 21, 2019

(65) Prior Publication Data

US 2021/0207857 A1 Jul. 8, 2021

(51) Int. Cl.
*F25B 31/00* (2006.01)

(52) U.S. Cl.
CPC ..... *F25B 31/004* (2013.01); *F25B 2400/075* (2013.01); *F25B 2500/16* (2013.01)

(58) Field of Classification Search
CPC ..... F25B 31/004; F25B 31/002; F25B 2400/075; F25B 2400/06; F25B 2500/16; F25B 43/02
USPC ..... 62/84
See application file for complete search history.

(56) References Cited

U.S. PATENT DOCUMENTS

| | | | | |
|---|---|---|---|---|
| 5,911,289 | A | 6/1999 | Waller | |
| 6,263,694 | B1 | 7/2001 | Boyko | |
| 2017/0176074 | A1* | 6/2017 | Crolius | F25B 31/004 |

FOREIGN PATENT DOCUMENTS

| | | | |
|---|---|---|---|
| CN | 102954624 | A | 3/2013 |
| CN | 204115299 | U | 1/2015 |
| CN | 106568217 | A | 4/2017 |
| CN | 206073492 | U | 4/2017 |
| CN | 107642921 | A | 1/2018 |
| CN | 107687725 | A | 2/2018 |

(Continued)

OTHER PUBLICATIONS

Pdf attached is the foreign reference (Year: 1970).*

(Continued)

*Primary Examiner* — Henry T Crenshaw
*Assistant Examiner* — Kamran Tavakoldavani
(74) *Attorney, Agent, or Firm* — Cantor Colburn LLP

(57) ABSTRACT

A compressor arrangement includes two or more compressors (16*a*, 16*b*) arranged in a fluidly parallel configuration and a lubricant sump (38) containing a volume of lubricant operably connected to the two or more compressors. A lubricant sump pressure (P) is greater than a lubricant cavity pressure of each compressor (Pa, Pb, Pc) of the two or more compressors at all operating conditions of the two or more compressors. An equilibrium lubricant line (40) connects the lubricant sump to the two or more compressors to convey lubricant from the lubricant sump to a lubricant cavity (42) of each compressor of the two or more compressors.

12 Claims, 4 Drawing Sheets

(56) References Cited

FOREIGN PATENT DOCUMENTS

| | | | | | |
|---|---|---|---|---|---|
| CN | 107747830 | A | | 3/2018 | |
| EP | 2990739 | B1 | | 9/2017 | |
| NL | 6818032 | A | * | 6/1970 | ..... F25B 1/00 |
| NL | 6818032 | A | | 6/1970 | |
| WO | 9639601 | A1 | | 12/1996 | |

OTHER PUBLICATIONS

Pdf file is foreign referecne NL 6818032 A (Year: 1970).*
Chinese Office Action for Chinese Application No. 201880094733.2; dated Oct. 9, 2021, 8 pages.
American Society of Heating, Refrigerating and Air-Conditioning Engineers, Inc., "Various—2010 ASHRAE Handbook Refrigeration—S1 Edition" Jul. 5, 2010, XP055557655, 3 pages.
International Search Report and Written Opinion for PCT/IB2018/000913, dated Mar. 6, 2019, 14 pages.

* cited by examiner

OIL SUMP FOR MULTI-COMPRESSOR HVAC AND R SYSTEM

CROSS REFERENCE TO RELATED APPLICATIONS

This application is a National Stage application of PCT/IB2018/000913, filed May 18, 2018, the disclosure of which is incorporated herein by reference in their entirety.

BACKGROUND

Exemplary embodiments pertain to the art of heating, ventilation, air conditioning and refrigeration (HVAC&R) systems, and more particularly to oil level regulation in HVAC&R systems having multiple compressors.

HVAC&R systems, such as chillers, use a compressor to compress a working fluid, such as a refrigerant, to flow through the HVAC&R system. It is becoming increasingly common for HVAC&R systems to have multiple compressors arranged in a fluidly parallel arrangement to accommodate a desired operating range, a desired level of capacity control and/or a desired level of efficiency of the HVAC&R system. In such systems, each compressor must be provided with a sufficient level of lubricant, such as oil, during startup and operation of the compressors.

In typical systems, oil returning to the compressors via, for example, a compressor suction line with the refrigerant, is not distributed equally among the compressors, or the oil level at a particular compressor is not sufficient for the particular compressor configuration. This may be a result of the compressors being of mixed configurations, such as unequal compressor sizes, or a mix of fixed and variable speed compressors being present, or other factors. Further, the distribution may be effected by operating status of the compressors, with some being "ON", while others are "OFF". Further, suction manifold configuration and pressure differences inside the compressor oil cavities effect oil distribution to the compressors.

Typical measures to address oil maldistribution include a line connecting compressor oil cavities to allow oil flow from one compressor to another, pressure drop regulators at compressor suction ports to reduce differences in oil level between compressors and suction line manifold design optimization in an attempt to reduce maldistribution of oil. Such solutions, however, are not reliable for all configurations and operational conditions.

BRIEF DESCRIPTION

In one embodiment, a compressor arrangement includes two or more compressors arranged in a fluidly parallel configuration and a lubricant sump containing a volume of lubricant operably connected to the two or more compressors. A lubricant sump pressure is greater than a lubricant cavity pressure of each compressor of the two or more compressors at all operating conditions of the two or more compressors. An equilibrium lubricant line connects the lubricant sump to the two or more compressors to convey lubricant from the lubricant sump to a lubricant cavity of each compressor of the two or more compressors.

Additionally or alternatively, in this or other embodiments the lubricant volume of the lubricant sump is sufficient to maintain a minimum lubricant level in the lubricant cavity of each compressor of the two or more compressors.

Additionally or alternatively, in this or other embodiments the equilibrium lubricant line connects to each compressor of the two or more compressors at the lubricant cavity below a minimum lubricant level.

Additionally or alternatively, in this or other embodiments the lubricant sump is operably connected to a suction line of the HVAC&R system such that the lubricant sump pressure is equal to a suction line pressure of the suction line.

Additionally or alternatively, in this or other embodiments a pressure equalizer line connects the suction line to the lubricant sump.

Additionally or alternatively, in this or other embodiments the equilibrium lubricant line is connected to the lubricant sump at a bottom wall of the lubricant sump.

In another embodiment, a heating, ventilation, air conditioning and refrigeration (HVAC&R) system includes an evaporator, two or more compressors operably connected to the evaporator via a suction line, and a lubricant sump containing a volume of lubricant operably connected to the two or more compressors. A lubricant sump pressure is greater than a lubricant cavity pressure of each compressor of the two or more compressors at all operating conditions of the two or more compressors. An equilibrium lubricant line connects the lubricant sump to the two or more compressors to convey lubricant from the lubricant sump to a lubricant cavity of each compressor of the two or more compressors.

Additionally or alternatively, in this or other embodiments the lubricant volume of the lubricant sump is sufficient to maintain a minimum lubricant level in the lubricant cavity of each compressor of the two or more compressors.

Additionally or alternatively, in this or other embodiments the equilibrium lubricant line connects to each compressor of the two or more compressors at the lubricant cavity below a minimum lubricant level.

Additionally or alternatively, in this or other embodiments the lubricant sump is operably connected to the suction line such that the lubricant sump pressure is equal to a suction line pressure of the suction line.

Additionally or alternatively, in this or other embodiments a pressure equalizer line connects the suction line to the lubricant sump.

Additionally or alternatively, in this or other embodiments the equilibrium lubricant line is connected to the lubricant sump at a bottom wall of the lubricant sump.

In yet another embodiment, a method of operating a heating, ventilation, air conditioning and refrigeration (HVAC&R) system includes urging a flow of refrigerant from an evaporator into two or more compressors via a suction line, the two or more compressors arranged in a fluidly parallel configuration. Lubricant is directed from a lubricant sump to the two or more compressors via an equilibrium lubricant line connecting the lubricant sump to a lubricant cavity of each compressor of the two or more compressors. A lubricant sump pressure is greater than a lubricant cavity pressure of each compressor of the two or more compressors at all operating conditions of the two or more compressors.

Additionally or alternatively, in this or other embodiments the lubricant volume of the lubricant sump is sufficient to maintain a minimum lubricant level in the lubricant cavity of each compressor of the two or more compressors.

Additionally or alternatively, in this or other embodiments the equilibrium lubricant line connects to each compressor of the two or more compressors at the lubricant cavity below a minimum lubricant level.

Additionally or alternatively, in this or other embodiments the lubricant sump is operably connected to the suction line such that the lubricant sump pressure is equal to a suction line pressure of the suction line.

Additionally or alternatively, in this or other embodiments a pressure equalizer line connects the suction line to the lubricant sump.

Additionally or alternatively, in this or other embodiments the equilibrium lubricant line is connected to the lubricant sump at a bottom wall of the lubricant sump.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
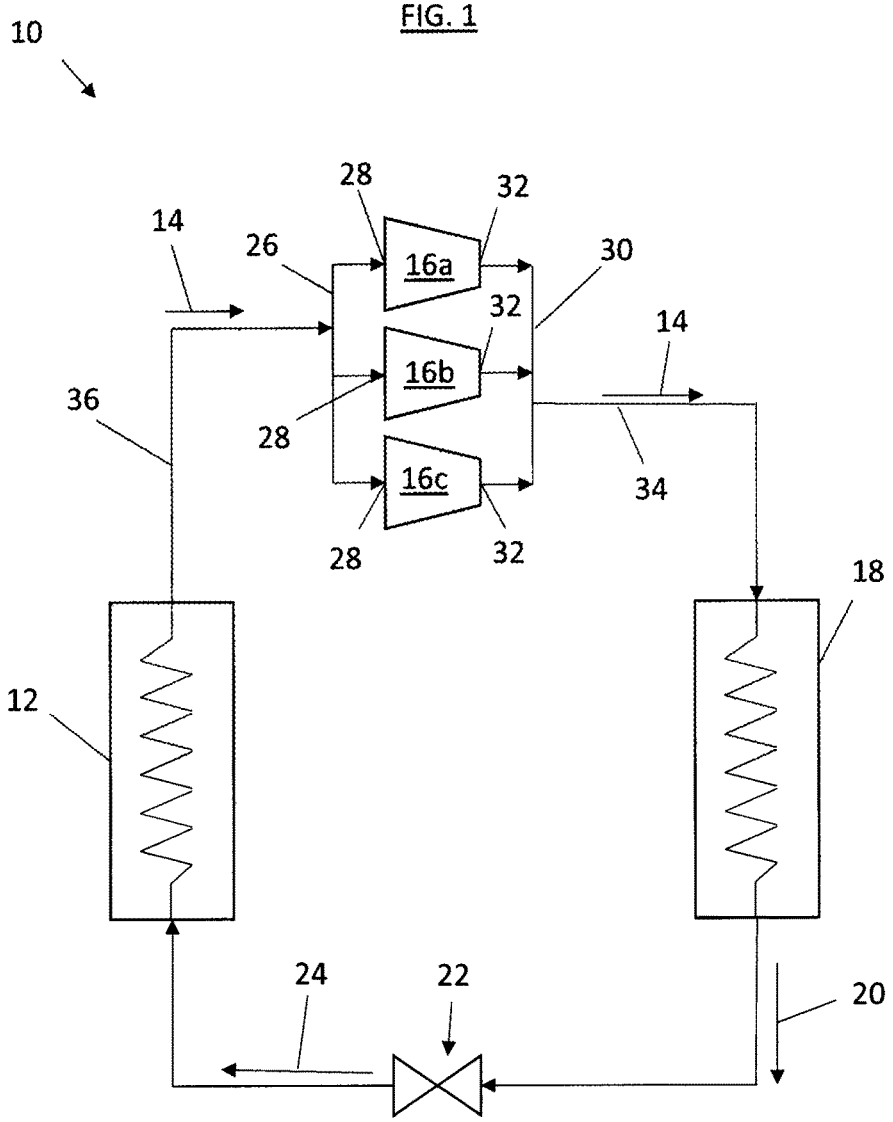
FIG. 1 is a schematic illustration of a heating, ventilation, air conditioning and refrigeration system.

Referring now to FIG. 1, shown is a schematic view of a heating, ventilation, air conditioning and refrigeration (HVAC&R) system 10. The HVAC&R system 10 includes multiple compressors 16 to compress a flow of vapor refrigerant 14. The flow of vapor refrigerant 14 is output from the compressors 16 and is directed to a condenser 18 that outputs a flow of liquid refrigerant 20 to an expansion valve 22. The expansion valve 22 outputs a vapor and liquid refrigerant mixture 24 toward an evaporator 12. The flow of refrigerant is vaporized at the evaporator 12 and is returned to the multiple compressors 16 completing the cycle.

The multiple compressors 16 are arranged in a fluidly parallel arrangement. While three compressors 16 are illustrated, it is to be appreciated that other numbers of compressors 16, such as 2, 4, or 5 or more compressors 16 may be utilized. Further, while in some embodiments, all of the compressors 16 may be identical, in other embodiments the compressors 16 may vary in size, capacity, and may include a mix of fixed speed and variable speed compressors 16.

A suction manifold 26 is located upstream of the compressors 16 between the evaporator 12 and the compressors 16 to distribute the vapor refrigerant 14 to the compressors 16 via suction ports 28 of each compressor 16. Similarly, a discharge manifold 30 connects a discharge port 32 of each compressor 16 to a discharge line 34 to direct the compressed vapor refrigerant 14 from the compressors 16 to the condenser 18.

Each compressor 16 is lubricated using oil or another lubricant. At least a portion of the oil is entrained in the refrigerant as the refrigerant flows through the HVAC&R system 10, and is returned to the compressors 16 via a suction line 36 connecting the evaporator 12 to the suction manifold 26.

Figure 2:
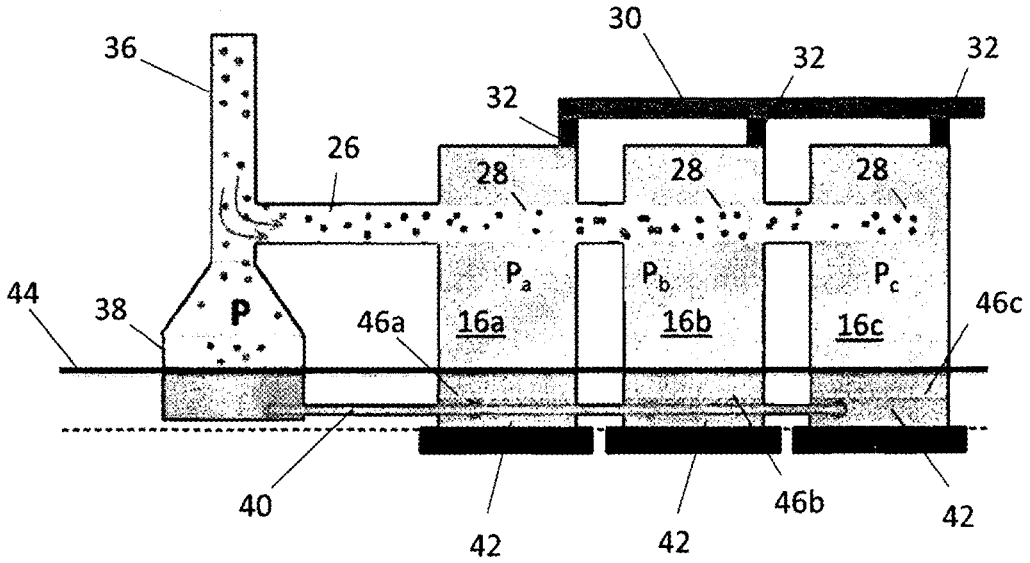
FIG. 2 is a schematic illustration of an oil distribution apparatus for compressors of a heating, ventilation, air conditioning and refrigeration system.

Referring now to FIG. 2, an oil sump 38 is connected to the suction line 36 and the suction manifold 26. An equilibrium oil line 40 connects the oil sump 38 to an oil cavity 42 of each compressor 16. The oil sump 38 is configured to collect at least a portion of the oil returning via the suction line 36, and to distribute the oil to the oil cavities 42 of the compressors 16 as needed.

The oil sump 38 has a pressure P that is equal to or greater than the oil cavity pressures $P_a$, $P_b$, $P_c$ of each of the compressors 16*a*, 16*b*, 16*c* at all times. In the operational situation illustrated in FIG. 2, $P=P_a=P_b=P_c$, and the oil levels in the oil sump 38 and in compressors 16*a*, 16*b*, 16*c* are at a nominal oil level 44. Each compressor 16*a*, 16*b*, 16*c* has a minimum allowable oil level 46*a*, 46*b*, 46*c*, below which damage to the compressor 16*a*, 16*b*, 16*c* may occur due to insufficient oil level.

The equilibrium oil line 40 is connected to the oil sump 38 at below the nominal oil level 44 and is connected to each of the oil cavities 42 of the compressors 16*a*, 16*b*, 16*c* at locations below the minimum allowable oil levels 46*a*, 46*b*, 46*c*. Since pressure P of the oil sump 38 is equal to or greater than the oil cavity pressures $P_a$, $P_b$, $P_c$ of each of the compressors 16*a*, 16*b*, 16*c* at all times, oil may always be directed to the oil cavities 42 from the oil sump 38, provided that the oil sump 38 has an adequate volume of oil present to distribute to the compressors 16*a*, 16*b*, 16*c*.

Figure 3:
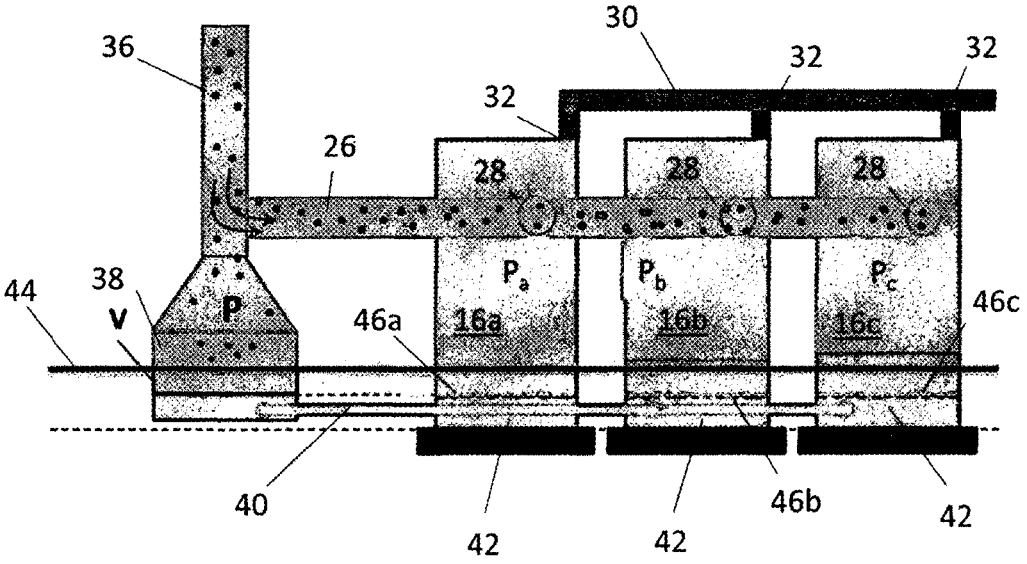
FIG. 3 is a schematic illustrating operation of the oil distribution apparatus of FIG. 2.

Referring now to FIG. 3, illustrated is an operating condition of the HVAC&R system 10, where P is approximately equal to $P_a$, and both $P_b$ and $P_c$ are less than P and $P_a$. Thus, oil levels in compressors 16*b* and 16*c* are higher than the oil level in compressor 16*a*. The oil sump 38 is sized such that a sump volume V above the minimum allowable oil level 46*a* is sufficient to keep the oil level in compressor 16*a* at or above the minimum allowable oil level 46*a* at all times.

Figure 4:
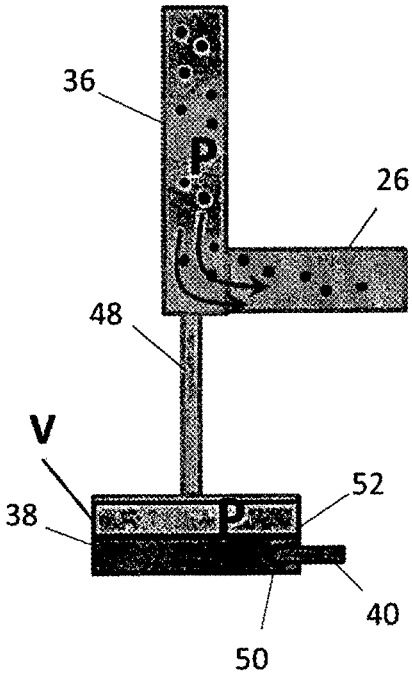
FIG. 4 is a schematic illustration of an oil sump configuration.

Referring to FIG. 4, another embodiment is illustrated. In the embodiment of FIG. 4, the oil sump 38 is connected to the suction line 36 via a pressure equalizer line 48. The pressure equalizer line 48 is configured such that both the suction line 36 and the oil sump 38 are at pressure P. A sump outlet 50, at which the equilibrium oil line 40 connects to the oil sump 38 is at a sump sidewall 52.

Figure 5:
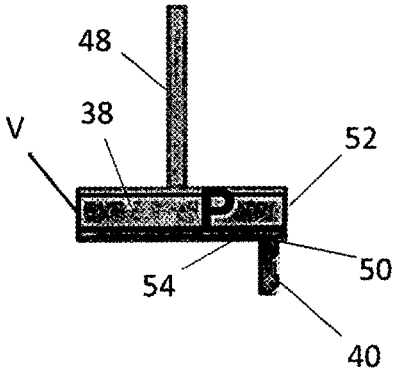
FIG. 5 is another schematic illustration of an oil sump configuration.

Another embodiment is illustrated in FIG. 5, in which the sump outlet 50 is located at a sump bottom wall 54, rather than at the sump sidewall 52. Locating the sump outlet 50 at the sump bottom wall 54 reduces the oil level required in the oil sump 38 compared configurations where the sump outlet 50 is at the sump sidewall 52.

The configurations of the present disclosure including the oil sump 38 arrangement in the multi-compressor HVAC&R system 10 improves oil management of the system 10, even in systems 10 with a mix of compressor configurations and/or sizes. The configuration allows for reliable, efficient operation of such complex HVAC&R systems 10.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A compressor arrangement, comprising:

two or more compressors arranged in a fluidly parallel configuration;

a lubricant sump containing a volume of lubricant operably connected to the two or more compressors, a lubricant sump pressure greater than a lubricant cavity pressure of each compressor of the two or more compressors at all operating conditions of the two or more compressors; and an equilibrium lubricant line connecting the lubricant sump to the two or more compressors to convey lubricant from the lubricant sump to a lubricant cavity of each compressor of the two or more compressors;

wherein the lubricant sump is operably connected to a suction line of the compressor arrangement such that the lubricant sump pressure is equal to a suction line pressure of the suction line;

wherein a pressure equalizer line connects the suction line to the lubricant sump.

2. The compressor arrangement of claim 1, wherein the lubricant volume of the lubricant sump is sufficient to maintain a minimum lubricant level in the lubricant cavity of each compressor of the two or more compressors.

3. The compressor arrangement of claim 1, wherein the equilibrium lubricant line connects to each compressor of the two or more compressors at the lubricant cavity below a minimum lubricant level.

4. The compressor arrangement of claim 1, wherein the equilibrium lubricant line is connected to the lubricant sump at a bottom wall of the lubricant sump.

5. A heating, ventilation, air conditioning and refrigeration (HVAC&R) system, comprising:

an evaporator;

two or more compressors operably connected to the evaporator via a suction line;

a lubricant sump containing a volume of lubricant operably connected to the two or more compressors, a lubricant sump pressure greater than a lubricant cavity pressure of each compressor of the two or more compressors at all operating conditions of the two or more compressors; and an equilibrium lubricant line connecting the lubricant sump to the two or more compressors to convey lubricant from the lubricant sump to a lubricant cavity of each compressor of the two or more compressors;

wherein the lubricant sump is operably connected to the suction line such that the lubricant sump pressure is equal to a suction line pressure of the suction line;

wherein a pressure equalizer line connects the suction line to the lubricant sump.

6. The HVAC&R system of claim 5, wherein the lubricant volume of the lubricant sump is sufficient to maintain a minimum lubricant level in the lubricant cavity of each compressor of the two or more compressors.

7. The HVAC&R system of claim 5, wherein the equilibrium lubricant line connects to each compressor of the two or more compressors at the lubricant cavity below a minimum lubricant level.

8. The HVAC&R system of claim 5, wherein the equilibrium lubricant line is connected to the lubricant sump at a bottom wall of the lubricant sump.

9. A method of operating a heating, ventilation, air conditioning and refrigeration (HVAC&R) system, comprising:

urging a flow of refrigerant from an evaporator into two or more compressors via a suction line, the two or more compressors arranged in a fluidly parallel configuration; and directing lubricant from a lubricant sump to the two or more compressors via an equilibrium lubricant line connecting the lubricant sump to a lubricant cavity of each compressor of the two or more compressors;

wherein a lubricant sump pressure is greater than a lubricant cavity pressure of each compressor of the two or more compressors at all operating conditions of the two or more compressors;

wherein the lubricant sump is operably connected to the suction line such that the lubricant sump pressure is equal to a suction line pressure of the suction line;

wherein a pressure equalizer line connects the suction line to the lubricant sump.

10. The method of claim 9, wherein the lubricant volume of the lubricant sump is sufficient to maintain a minimum lubricant level in the lubricant cavity of each compressor of the two or more compressors.

11. The method of claim 9, wherein the equilibrium lubricant line connects to each compressor of the two or more compressors at the lubricant cavity below a minimum lubricant level.

12. The method of claim 9, wherein the equilibrium lubricant line is connected to the lubricant sump at a bottom wall of the lubricant sump.

* * * * *